US005949004A

United States Patent [19]

Orii et al.

[11] Patent Number: 5,949,004

[45] Date of Patent: Sep. 7, 1999

[54] COMPACT MUSIC BOX

[75] Inventors: Makoto Orii; Shinroku Asakawa, both of Nagano, Japan

[73] Assignee: Sankyo Seiki Mfg. Co., Ltd., Nagano-ken, Japan

[21] Appl. No.: 08/727,323

[22] Filed: Oct. 8, 1996

Related U.S. Application Data

[63] Continuation of application No. 08/570,915, Dec. 12, 1995.

[30] Foreign Application Priority Data

Dec. 17, 1994 [JP] Japan ..... 6-334115
Sep. 6, 1995 [JP] Japan ..... 7-228803

[51] Int. Cl.[6] ..... G10F 1/06

[52] U.S. Cl. ..... 84/95.1; 84/94.1; 84/94.2; 84/95.2; 84/96

[58] Field of Search ..... 84/94.1, 94.2, 84/95.1, 95.2, 96–100

[56] References Cited

U.S. PATENT DOCUMENTS

| | | | |
|---|---|---|---|
| 4,197,778 | 4/1980 | Komatsu et al. | 84/95 R |
| 4,458,573 | 7/1984 | Isaka . | |
| 4,464,969 | 8/1984 | Isaka et al. . | |
| 4,557,173 | 12/1985 | Isaka | 84/95 R |
| 4,570,524 | 2/1986 | Isaka et al. . | |
| 5,449,856 | 9/1995 | Nakamori . | |
| 5,532,423 | 7/1996 | Liu | 84/95.2 |
| 5,877,439 | 3/1999 | Asakawa et al. | 84/95.1 |

FOREIGN PATENT DOCUMENTS

| | | |
|---|---|---|
| 1772964 | 12/1970 | Germany . |
| 39-19691 | 9/1964 | Japan . |
| 43-26682 | 6/1968 | Japan . |
| 60-7301 | 1/1985 | Japan . |
| 2335591 | 4/1945 | Switzerland . |

OTHER PUBLICATIONS

Patent abstracts of Japan vol. 009, No. 120 (P–358), May 24, 1985 & JP, A, 60 007301 (Ken Yamamoto), Jan. 16, 1985.

*Primary Examiner*—Jonathan Wysocki
*Assistant Examiner*—Marlon T. Fletcher
*Attorney, Agent, or Firm*—McAulay Nissen Goldberg Kiel & Hand, LLP

[57] ABSTRACT

A music box is arranged for increased compactness. The music box includes a comb having vibrating teeth, a drum with a rotational axis with a plurality of pins on an outer surface for engaging ends of said teeth, a coil spring having a winding shaft for driving the drum, an accelerating gear row for accelerating the rotation speed of the spring winding shaft, a braking member engaging with the gear row for braking and a base frame for transmitting the vibration of the comb to a mounting member. The rotational axis of the drum and the spring shaft are arranged vertical to the base frame and the spring shaft is substantially centered on the frame. The drum, comb, accelerating gear and brake are disposed about the centered spring shaft to provide a more compact arrangement.

25 Claims, 11 Drawing Sheets

COMPACT MUSIC BOX

This is a continuation of application Ser. No. 08/570,915, filed on Dec. 12, 1995.

BACKGROUND OF THE INVENTION a) Field of the Invention

This invention relates to a music box with a spring as a driving source. Further, this invention relates to an improvement of a music box typically combined with a doll or other toys or ornaments. Such music box is utilized as a power source for movable members such as dolls and ornaments.

b) Description of the Related Art

A music box of conventional design is disclosed in U.S. Pat. No. 4,458,573 ("the U.S. Pat. No. '753"). In the conventional music box shown in FIG. 1 of the U.S. Pat. No. '573, there is a dead space between the comb 6 and the frame 1 and/or in the hole under the drum 2. As a result of the large space occupied by the drum and the comb, such conventional music box cannot be made compact. This fact makes the cost for shipping the music box expensive. A further problem exists in this construction in that an ornament which accommodates or is to be used with the music box cannot be small.

In such conventional music boxes, the spring winding shaft is forced to be arranged at a corner of the frame 1. When an ornament accommodating or cooperating with a music box is rotated on a stand formed as a handle of the winding shaft, the following problems occur:

(1) if the music box is located at the center of the ornament, the rotation center is at the corner of the ornament creating eccentric rotation, thus requiring extra space; and (2) if the spring axis of the music box is located at the center of the ornament, the ornament must be large-sized.

OBJECT AND SUMMARY OF THE INVENTION

The primary object of this invention is to provide a music box which is compact as compared to conventional music boxes. Another object of this invention is to provide a music box wherein the winding shaft can be arranged at the center of the ornament without using any extra space when the music box is installed in the ornament or the toy; in this way, the winding shaft is rotated to obtain a motion (an action) and the music box is well-balanced.

In accordance with the invention, an improvement is provided for a music box having a comb with a plurality of vibrating teeth, a drum having a rotational axis with a plurality of pins on an outer surface thereof for engaging ends of said teeth, a coil spring having a shaft for driving the drum and a base frame to which the comb, drum and coil spring are mounted. The improved arrangement includes that the rotational axis of the drum and the shaft of the spring are arranged substantially parallel to each other and vertical to the base frame and that the shaft of the coil spring is substantially centered in the base frame. Further, the comb and the drum are disposed on the base frame about the centered shaft of the coil spring.

DESCRIPTION OF THE PREFERRED EMBODIMENTS

Figure 1:
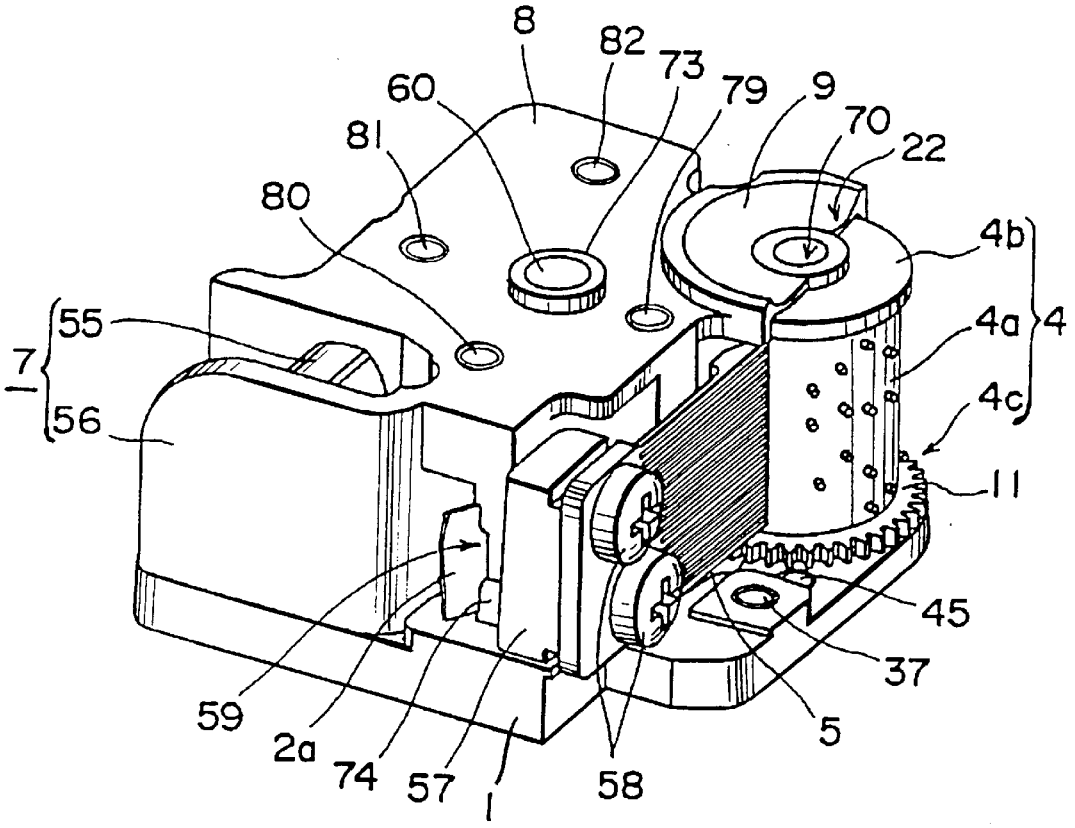
FIG. 1 illustrates a perspective view showing an example of a music box of this invention.
Figure 2:
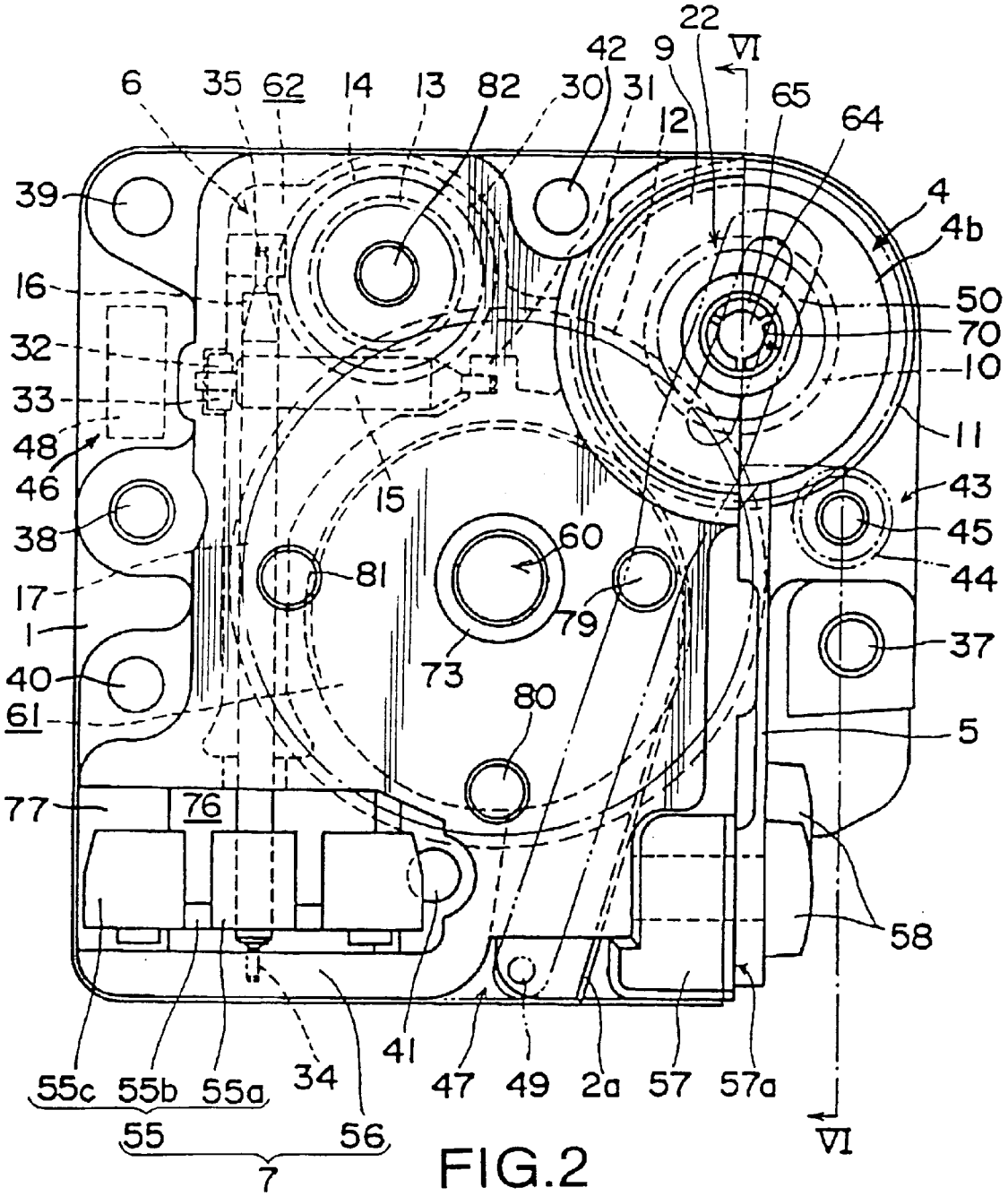
FIG. 2 illustrates a top view of the music box of FIG. 1.

FIGS. 1 to 10 show examples of a music box of this invention. In this music box, a spring 2 and its winding shaft 3 are arranged at about the center of a square frame 1; a drum 4, a comb 5, an accelerating gear row 6, and a brake member 7 are respectively arranged at four corners of the frame 1; the spring 2, its winding shaft 3 and the accelerating gear row 6 are covered by a case 8.

Figure 8:
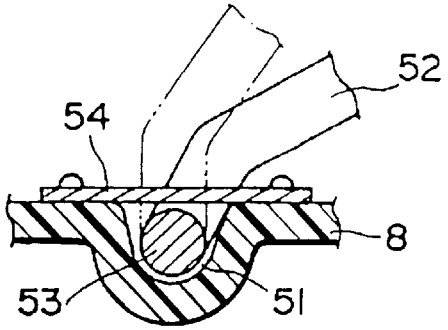
FIG. 8 illustrates a cross section of an example of directly mounting an attachment on the case upper surface.
Figure 9:
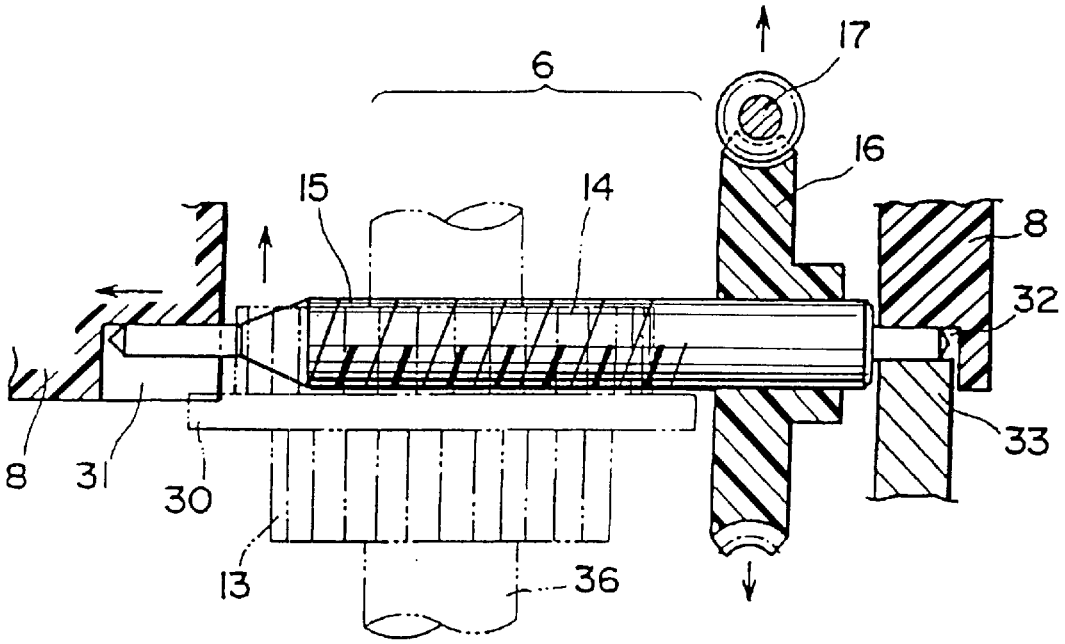
FIG. 9 is an illustration of the relationship between a support structure of the third worm constituting an accelerating gear row and other gears meshing with the third gear.
Figure 10:
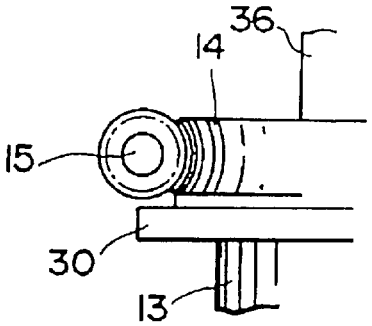
FIG. 10 is an illustration of the relationship of the third worm gear, the second worm wheel, and flange.
Figure 11:
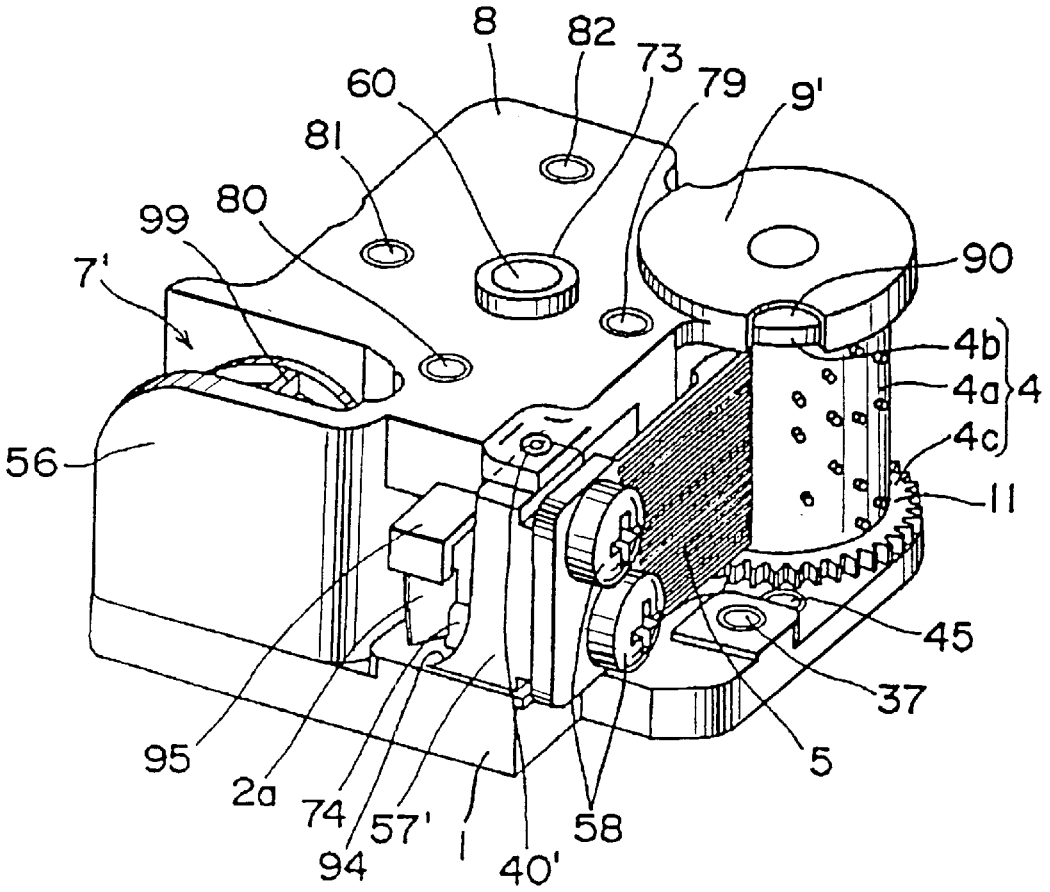
FIG. 11 is a perspective view of the second example of a music box of this invention.

In this example, the upper surface of the case 8 is flat with a size to cover most of the frame 1. On the top, a stopper and an attachment can be fixed; the attachment transmits the rotation and the linear movement to the movable member such as an ornament. When the music box is assembled, the case can be upside down to install a gear wheel and a drum. Then, it is completed with a frame cover. Accordingly, as shown in FIG. 8, if a U-shape groove 51 is created on the upper surface of the case 8, the attachment edge part 53 can be accommodated in the groove 51; if the groove 51 is covered by the upper board 54, the attachment 52 can be supported to be freely moving within the vertical surface without a ground board. In this example, a gear housing 62, a drum support 9, and a fixed wall 56 are formed of plastic and united to constitute a case 8: the gear housing 62 contains a spring housing 61 and the accelerating gear row 6; the drum support freely supports the drum 4 with the frame; and the fixed wall 56 brakes the accelerating gear row 6 when a rotor of a brake member 7 contacts it. In this case, the case 8 is constituted so as to resonant easily, thus functioning as a resonator and preventing lowering of the sound volume accompanied by the miniaturized frame 1.

As described above, the advantage is that the place to fix the attachment and the ground board, which transmits the movement to the movable member such as an ornament, can be spacious; however, it is not so limited. For example, the spring housing 61, the gear housing 62, the drum support 9 and the fixed wall 56 can be formed separately or partially separated, and they can be connected to each other on the frame 1. In any case, if not only the spring 2 but also all the gears 12–17, the drum 4, and the brake member 7 are covered with the integrated or the separated case, the entire shape of the music box is about square with flat surfaces.

There is no structural weak point when pressed; there is no chance for the gear row 6 to get dust from packing members and other members. Therefore, packing cushions such as Styrofoam are not necessary for shipping. Styrene resin cushions such as Styrofoam are generally regarded as disturbing to the ecology of the earth and an ecological movement to avoid using these members is prevalent in the world. Therefore, it is advantageous that shipping does not require Styrofoam. Further, the shipping cost can be reduced because the use of Styrofoam is unnecessary.

The drum 4 is arranged vertically against frame 1 at the corner of frame 1 and supported by frame 1 and the drum support 9 which is projected from the case 8 in parallel to frame 1; a required condition is that it freely rotates around the vertical center. Therefore, the plane figure of the drum 4 projected on frame 1 is a circle, showing a smaller area as compared to conventional ones. In this specification, the area of a projected plane figure is called an occupancy area. In this example, the drum 4 is comprised of:

(a) a body 4*a* with pins hammered out from the inside to play the comb 5;

(b) an end board 4*b* which covers one end of the body 4*a* and constitutes a support part; and (c) another end board 4*c* where a pinion 10 meshed with a gear 12 (called the first gear) formed on the spring winding shaft 3 and a gear 11 are integrated to transmit a rotation to a movable member such as an ornament.

Each of the end boards, 4*b* and 4*c*, is press-fixed to the body 4*a*. The lower end board 4*c* is supported by the drum support hole 18 which is formed on the frame 1; the upper end board 4*b* is fit into a tapered cylinder part 19 which sticks out from the support member 9 in case 8; in this way, the drum is rotatably supported. The drum support hole 18 has a bottom because it is not through the frame 1; however, it can be made to be through the frame 1. In order to lower the music box height around the drum 4, a cavity 20 is formed around the drum support hole 18 so that the pinion 10 of the drum lower end can be installed. Pins 4*d* are projected on the peripheral surface of the drum 4 to play a comb 5.

The drum is designed to equip the external output shaft 63 at the center of the drum by one touch to directly transmit the rotation outside without passing through other gears. For example, in the center of the upper end board of the drum 4 (identified with a rotation center), a passing hole 64 is opened for the external output shaft 63 to go through outside. At the same time, an elastic arm 66 is formed in the middle of the cylinder; the arm 66 has a stopper nail 65 sticking out towards the inside of the drum diameter and is open and shut to diameter direction. Further, an engagement part 67 made with spline or serration is arranged at about the rotation center line of the drum 4, in the end board 4*c*. The purpose of engagement is to practically integrate the top of the external output shaft 63 with the drum in the same rotation direction of the drum by a perfect press-fit. At this time, at the drum 9, a passing hole 70 is arranged with larger diameter than that of the passing hole 64 of end board 4*b* so that the external output shaft 63 does not contact the drum support 9. The stopper nail 65 is engaged with a circular groove 68 formed on the external output shaft 63. Regarding the engagement part 67, it is desirable to form the part to control the depth that the external output shaft 63 is pushed in; usually, the bottom of the hole 69 with spline or serration works as the position determination part. When the stopper nail 65, the circular groove 68, and the engagement part 68 are utilized, the external output shaft 63, such as a straight shaft to transmit the rotary movement or a curved shaft to give oscillating movement, is simply inserted from the top of the drum. In this way, the external output shaft 63 can be fixed and integrated with the drum to rotate in the same rotation direction. At this time, the direct rotary output can be transmitted from the drum by the huge torque to the vertical direction. It is necessary to protect the gear 11 from an impact such as falling because the gear 11 is formed at the end board 4*c* of the drum 4 to transmit the rotation to activate the movable member of the ornament. Therefore, in this example, the frame 1 is formed slightly larger than the gear 11 to cover the gear 11. Accordingly, when the music box falls, first frame 1 which is hard takes the impact, protecting the gear from damage.

The supporting part 9 supporting the upper end of the drum 4, is made of the same material, such as plastic, as the case 8 as one unit. The drum support 9 has a diaphragm-shape spring elastic part 22 to obtain a spring mechanism which gives a constant pressure to insert and push a tapered cylinder shaft 19 into the tapered hole 21 of the drum; a part of the spring elastic part 22 is formed thin to give a spring function; the tapered cylinder shaft 19 is formed inside the spring elastic part 22.

The comb 5 is fixed, for example, by machine screws 58 on the side wall 57*a* of the stand 57 which is projected from frame 1 in the vertical. The occupancy area is about the same as the thickness of a board, that is, a much smaller area compared to a conventional one. (In this specification, this condition is called an arrangement where the comb 5 is facing side.) On the surface of the stand 57, to which machine screws 58 are inserted, the comb mounting space 87 is made to have about 0.5 mm concavity. Because of this comb mounting space 87, the comb 5 can be fixed firmly to the stand 57. When the comb 5 is fixed, the end of the comb 5 is engaged with the pins 4*d* of the drum and overlaps the rotation center axis of the drum. Normally, the side wall surface 57*a* of the stand 57 is in line with the central axis of the drum 4, but it is changeable as long as the range of the sound has good quality. The stand 57 for the comb 5, integrated with the frame, is best made in a trapezoid shape to make it easy to draw at casting. The comb 5 is best placed and fixed in such a way that the high frequency side is closer to the frame 1 (a larger space of the stand), and the low frequency side is far away from the frame 1 (a narrow space of the stand). Accordingly, the drum 4 is placed in such a way that the high frequencies side is closer to the frame 1 and the low frequency side is closer to the support member 9. Therefore, the high frequency side with high frequency energy is supported more firmly, preventing the rough vibration and the pressure from the spring elastic 22 prevents uneven rotation of the drum.

Figure 3:
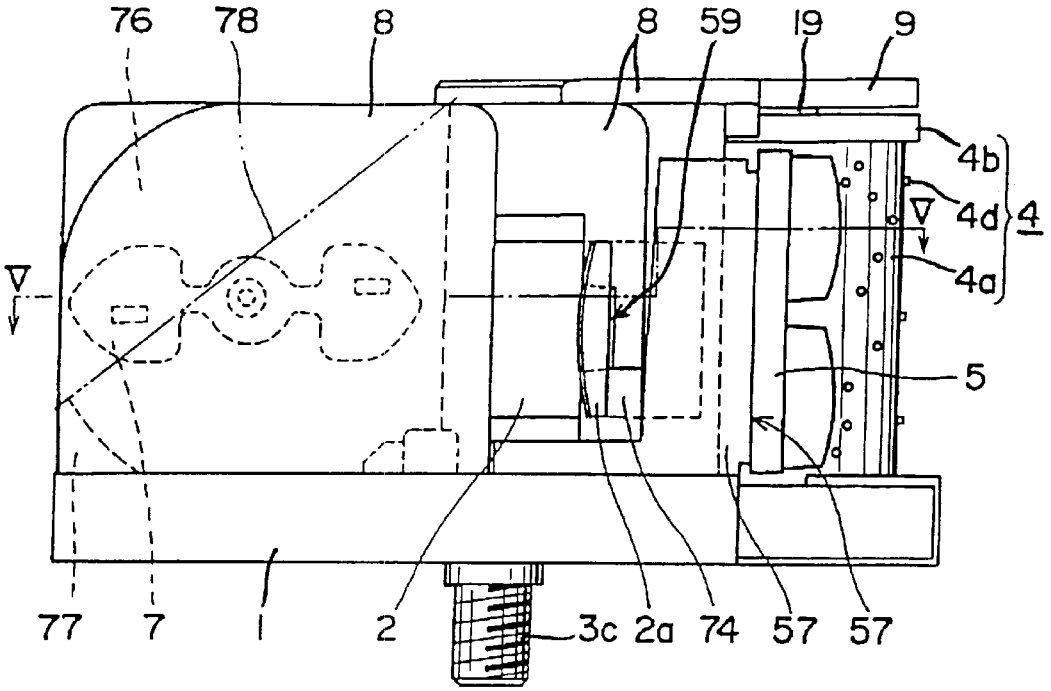
FIG. 3 illustrates a front view of the music box of FIG. 1.
Figure 4:
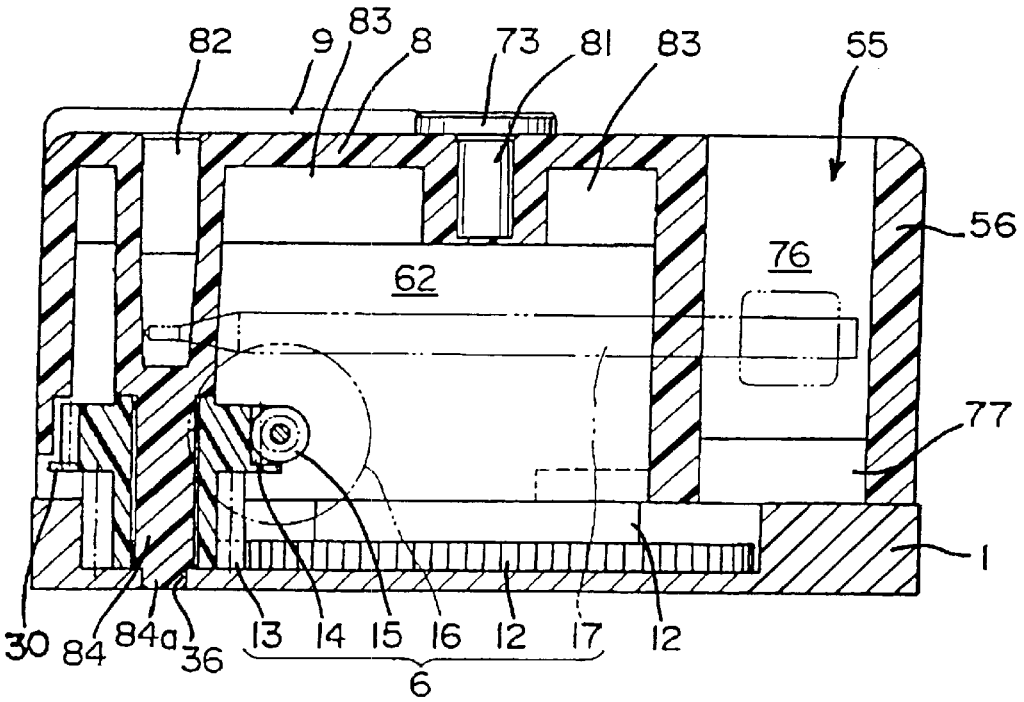
FIG. 4 illustrates a left side view of the music box of FIG. 1.
Figure 5:
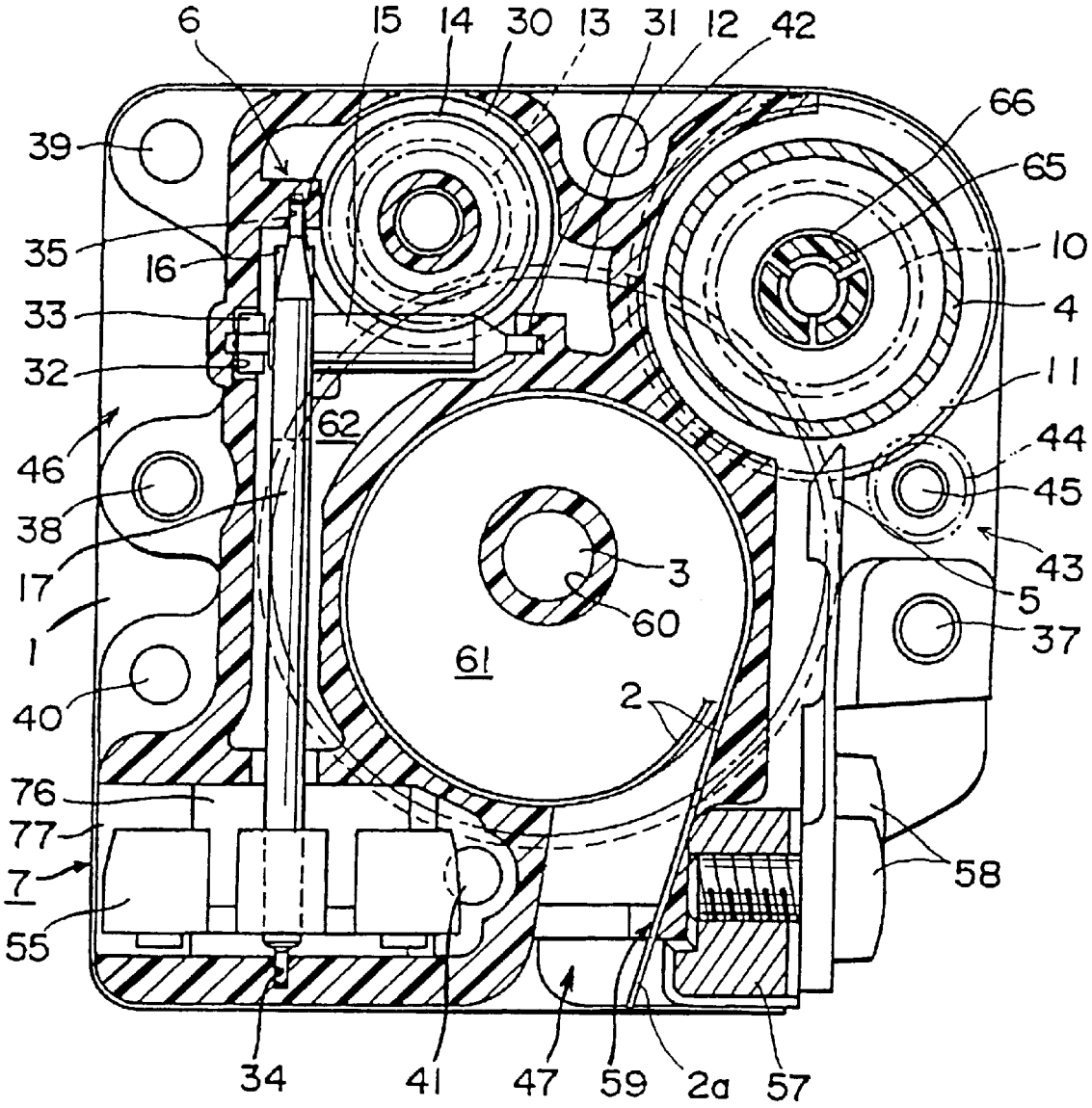
FIG. 5 illustrates a top view of the case of FIG. 3 crossed along line V—V of FIG. 3.
Figure 6:
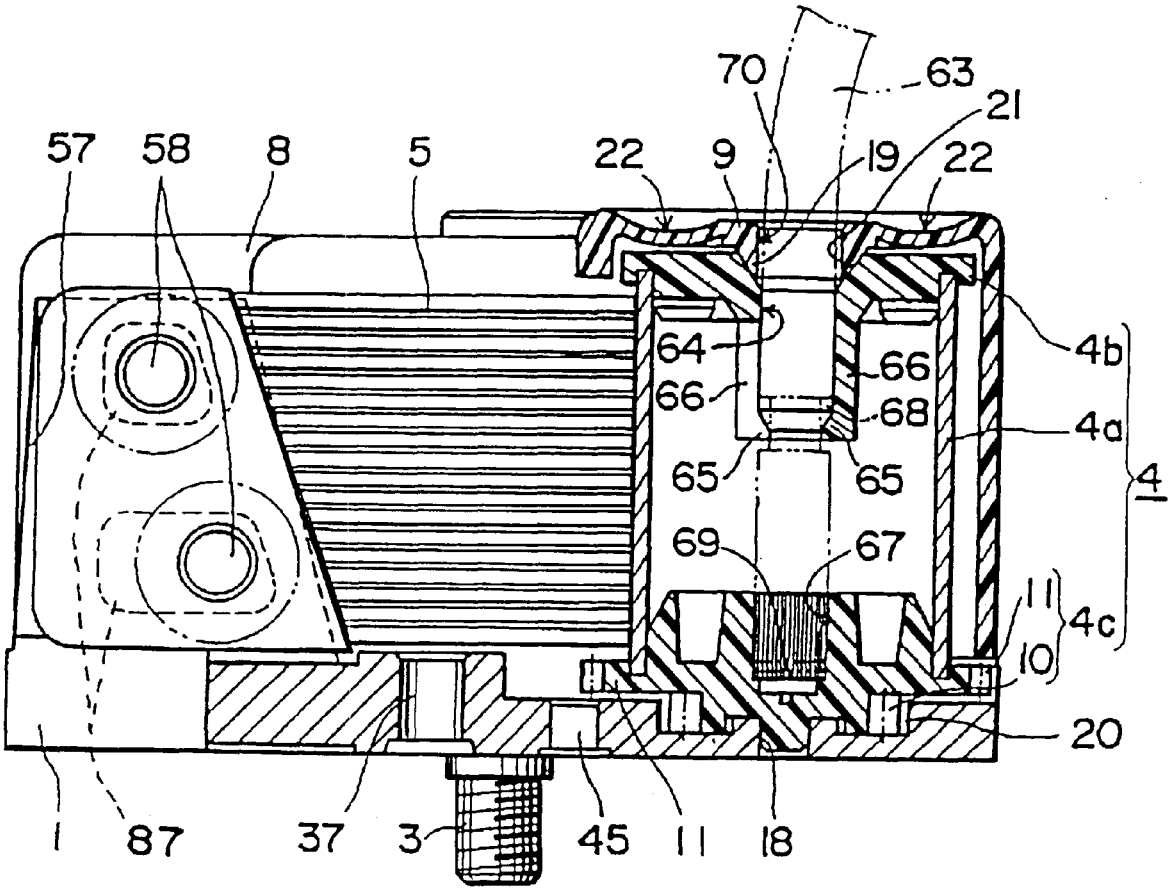
FIG. 6 shows a line VI—VI as cross section of FIG. 2.
Figure 7A:
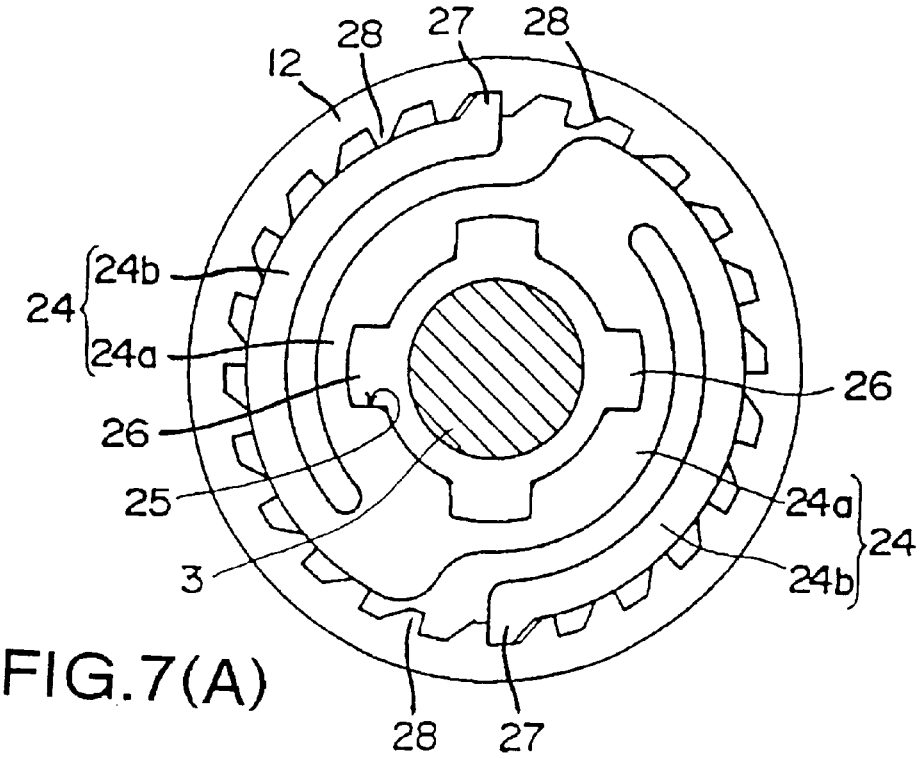
FIGS. 7(A) and 7(B) show an example of ratchet connecting a winding shaft to the first gear where FIG. (A) is a top view and FIG. 7(B) is a vertical section.
Figure 7B:
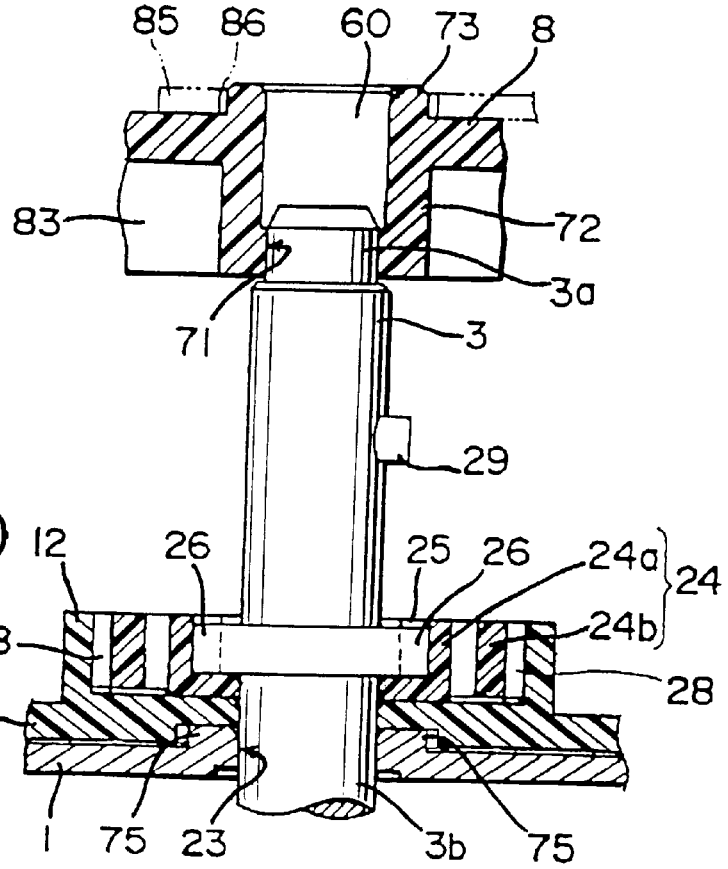

The winding shaft 3 of the spring 2 is arranged to go through the frame 1 at about the center of the frame and is rotatably supported by the spring housing 61 of the case 8 and the frame 1. As shown in FIGS. 3, 5, and 7 (B), for example, the winding shaft 3 is supported in such a way that the upper end of the shaft 3*a* is fit into the bearing hole 71 made in the boss 72, while the lower end of the axis 3*b* is through the bearing hole 23 of the frame 1 and sticks outside frame 1; the boss 72 is arranged at about the center of the frame 1, deviating from the center of the spring housing 61. The lower end shaft 3*b* of the winding shaft 3 which sticks out of frame 1 is threaded as screw 3*c*, to which a handle (no Figure) or a stand (no Figure) is usually mounted. In the middle of winding shaft 3, the stop pin 29 (shown in FIG. 7B) is fixed so that it sticks out in the diameter direction to engage the inner end of spring 2. Utilizing this stop pin 29 and the inner end hole (no Figure) of the spring 2, the spring 2 is hooked; as the winding shaft 3 rotates in the winding direction, the spring 2 is wound into the spring housing 61 of the case 8. The ear 2*a*, the outer end of the spring 2, is hooked to the spring engagement opening 59, which consists of the side wall surface of the case 8 and the ribs 74 of the frame 1, and is stopped. The ribs 74 of frame 1 which form the spring engagement opening 59 at the side wall of the case 8 is integrated into one piece with the stand 57 so that they are connected to the comb 5. The ribs function as ribs and at the same time increase the sound volume of the stand 57, thus improving sound transmission.

The spring 2 is wound into the housing part 61 by using the winding shaft 3 after the music box is assembled. Further, in order to prevent the edge of the spring 2 from coming off from the pin 29 of the winding shaft 3, a strong torque is used to wind up the spring 2. This work process is automatically and mechanically performed with high speed, utilizing the winding screw 3*c* of the winding shaft 3 and an automatic spring winder. After winding up using the reversed rotation, the automatic spring winder is removed from the winding screw 3*c*. Then the music box plays with the stored power in the spring 2 and the music box stops playing after the stored power is released.

The first gear 12 connected to the winding shaft 3, as the pinion 10 of the drum 4, is installed in the cavity, in other words, in the lowest position in the frame 1 and supported rotatably at the convex 75 around the bearing hole 23 of the frame 1. On the top of it, the spring 2 is arranged. This winding shaft 3 and the first gear are connected through the ratchet 24 to transfer the rotation in one direction only. As shown in FIG. 7 (A) for example, the ratchet 24 is S-shape in cross section; the center circle part 24*a* is engaged with the winding shaft 3 in the rotation direction only. Indentations 25 are formed at the inner peripheral surface of the circle 24*a* every 90 degrees. These indentations are engaged with the convex pieces 26 formed at the outer peripheral of the winding shaft 3 at every 90 degrees so that both the winding shaft 3 and the ratchet 24 rotate together. The arcuate elastic arm 24*b* is formed symmetrically at every 180 degrees and at its edge the nail 27 is arranged, which engage, in the one direction only, with the nail 28 formed on the inner peripheral surface of the boss part of the first gear. The nails 28 are arranged at every 15 degrees at the equal intervals of 1/24 of a circle. At the winding of the spring, it makes latch sounds creating a good feeling as it passes the nails 28. In FIG. 7, these nails have the teeth of the normal direction to engage with the nail 27 at the counterclockwise direction of the ratchet 24; at the clockwise direction of the ratchet 24, the elastic arm 24*b* is deformed toward the inside to form slopes so that the ratchet nail 27 cannot transmit the rotation crossing the nail 28 of the first gear 12.

Further, one of the important objects of this example is to make a compact music box. In concrete terms, it is aimed to make the size smaller than conventional ones (40×50 mm frame size) which are most prevalent in the market, while maintaining the same playing period and an equal or better note range; the size of this music box according to the invention is about 25% smaller than conventional ones, and is about 40×40 mm square or an almost square shape such as 39×41 mm including the frame. If the frame size is smaller than the conventional ones and the shape is about square, the frame can be installed in a square or round decorative case in any direction; the winding shaft 3 can be arranged at the center of the case and the rotation of the drum at a corner can be transmitted into the rotation axis direction. By simply rotating the position or the facing direction of the frame 1 around the winding shaft 3, the rotation for the movable member driven by a music box can be transmitted from any preferred corner of the square case. If the ornament is round, the music box of this example can be installed in the case which has a slightly larger inner peripheral wall surface than the circumscribed circle of the frame 1. Thus, the ornament containing the music box can be compact. In the music box of this invention, the occupancy area of the drum 4 and the comb 5 are much smaller than that of the conventional music box; besides, not only there is no need to make a hole under the drum to lower the height of the drum 4 on the frame 1, but there is also no need to make the space under the comb 5. Moreover, by utilizing the space created from the drum 4 standing vertically and the side of the comb 5, as the space for the mounting hole 37, each component can be put together without wasting the space. Further, the size of the frame is smaller with less projections, resulting in a much lighter weight, for example, about 30% lighter.

In order to make a smaller music box without deteriorating performance, the accelerating gear row 6 is designed to be put to be as close to the spring 2 as possible. That is, the crossing two worms 15, 17 are arranged to be as close to the spring 2 as possible. By adapting two steps of the worm 15, 17, accelerating ratio can be greater and the gear row can be compact, thus saving space. The first gear 12 is connected to the brake member 7 through not only the pinion 10 but also the accelerating gear row 6. The accelerating gear row 6 is composed of:

(1) the second gear 13 which meshes with the first gear 12;

(2) the second worm wheel 14 on the same axis of the above;

(3) the third worm wheel 15 which meshes with the second worm wheel 14;

(4) the third worm wheel 16 arranged on the same axis of the third worm wheel 15; and (5) the fourth worm wheel 17 which meshes with the third worm wheel 16.

The brake member 7 is mounted to the fourth worm 17. This accelerating gear 6 is covered with the gear housing 62. With this, the accelerating gear row is protected from dust and fluff. Because of this protection, even if uniforms and the atmosphere in a plant are contaminated with dust and fluff, they do not get into the gear wheel or the shaft of the accelerating gear row.

The third worm 15 arranged at the upper side, the case 8 side of the first gear 12, can not directly stick out of the support part from the frame due to the block of the first gear 12. However it is difficult and not preferable to form the support part from the outside of the first gear, because the structure becomes too complicated and the positioning of other gears is limited inside the limited gear housing space. As shown in the FIG. 9, the third worm 15 is designed in such a way that when the rotation is transmitted from the second worm wheel 14 to the third worm 15, it is pushed to the bearing 31 of the case 8, by the thrust in the arrow direction and the force in the radial direction affecting the third worm 15. The bearing 31 consists of a reversed U shape groove, which opens downward, to prevent the axis end of the third worm 15 from moving up and to the side. As shown in the FIGS. 9 and 10, a flange 30 is arranged underneath of the second worm wheel 14, supporting the third worm 15 when the rotation is not transmitted. The other end of the third worm 15 is rotatably supported by (1) the reversed U-shape bearing 32 formed on the side wall of the case 8 and (2) the convex piece 33 projected from the frame 1 side and the third worm 15 is fit to the bearing 32. At the crossing position of the third worm 15 and the fourth worm 17, the third worm wheel 16 is positioned and, on the top of it, the fourth worm 17 is arranged meshing with it. One end of the fourth worm 17 is inserted to the bearing hole 34 of the case 8 and the other end is supported by the worm wheel 16 and the reversed U shape bearing groove 35. Therefore, it is not necessary to have a projection to support the other end of the worm 17 from underneath and fewer projections from the frame are needed; due to the support at the position near the frame, the height can be lower.

The second gear 13, the second worm wheel 14 and the flange 30 are formed integrally of plastics or metals if needed and rotatably supported by the shaft 84, which is unified with the case 8 and projected from the case 8 side to the frame 1 side. The shaft 84 is formed at the ceiling of the gear housing 62 of the case 8, projecting to the frame 1 side; it is supported by the frame 1 and case 8, with the top part 84*a* fitting into the supporting hole 36 of frame 1. This shaft 84 becomes long because the gear 13 and the worm wheel 14 are arranged at the low position of the frame 1 side. In order to prevent a strain of plastics at manufacturing, it is necessary to make this hollow and to make the thickness even. Therefore, the hollow is utilized as the hole 82 to mount a movable member. This mounting hole 82 can be made deeper than other mounting holes 79, 80, 81 and can be used to fix the attachment which requires the strongest fixation.

The brake member 7 is composed of a rotor 55 made of elastic material such as rubber or a rubber imitation and a fixed member 56 which contacts to the rotor 55. In this example, the fixed member 56 is constituted by a wall (a fixed wall 56) united to the case 8. The rotor 55 is comprised of:

(1) a boss 55*a* press-fit to the fourth worm 17's shaft;

(2) a pair of friction members 55*c*, 55*c*, sticking out from the boss 55*a* in the diameter direction; and (3) the connectors 55*b*, 55*b* which connect the boss 55*a* and the friction members 55*c*, 55*c*.

The connectors 55*b*, 55*b* are made relatively thin and are bent by centrifugal force of the friction member 55*c*, 55*c* at the rotation. This makes it possible for the friction member 55*c*, 55*c* to change direction to touch the wall surface of the fixed wall 56. This rotor body 55 rotates with the fourth worm gear rotation, receiving the air resistance while it applies the brake touching the wall surface of the fixed wall 56. Therefore, it can maintain constant rotation of the accelerating gear row 6 as well as constant rotation of the drum 4 which is connected to the accelerating gear row 6.

There is a space 76 to rotatably accommodate the rotor 55 arranged between the gear housing 62 of the case 8 and the fixed wall 56. At the corner where the side opening and the bottom side opening of the space 76 are adjacent, the bridge 77 which connects the fixed wall 56 and the gear housing 62, are integrated with them. As shown in FIG. 3, this bridge has a triangle shape in cross section. The bridge is rotatably supported so that the shaft of the fourth worm 17 which is fixed with the rotor 55 is arranged at a position closer to the frame 1 than the diagonal line 78 which is connecting the upper part of the bridge 77 and the upper part of the connecting part between the fixed wall 56 and the spring housing 61. In this case, when the corner of the fixed wall is impacted by a fall, the neighboring piece which supports the shaft of the fourth worm 17 does not bend. Although there is no Figure, by utilizing the opening above the open space 76 or the holes properly arranged on the fixed wall 56, a stopper is formed to be inserted into the open space 76. The stopper is contacted by friction members 55*c*, 55*c* or the connection member 55*b*, 55*b* to prevent the rotation of the brake member 7 and the music box stops playing. It is important to determine how to mount frame 1 to a mount of product made of wood, synthetic resin, metal, and glass etc. to improve resonance. If it is fixed apart from comb 5, the frame is not stable and pushed for mounting; it is necessary to push in evenly to prevent strain or unbalance of the frequency of transmission. Therefore, traditionally, there are three spots close to the frame outer peripheral, the corners of a triangle shape, to fix the outside frame by machine screws. However, it is desirable to fix as few points as possible in order to speed up the mounting process. In this example, the holes 37 and 38 are arranged at the symmetrical point between the bearing hole 23 on the straight line running through the bearing hole 23 near the comb 5; the bearing hole 23 contains the winding shaft 3 at the center of frame 1. In this way, with the least fixing spots, the frame 1 can be fixed firmly in the decorative case so as to provide the best sound effect.

At frame 1, there are four holes 39, 40, 41, 42 for caulking. To fix the case 8, caulking pins projected from the frame 1 can be inserted into these four holes, 39, 40, 41, 42, and their heads are crushed to fix the case to the frame. According to circumstances, machine screws can be used, instead of the caulkings, to fix the case 8.

In the case 8, multiple mounting holes, for example, holes 79, 80, 81, 82, are formed. Further, above the bearing hole 71, a cavity 60 is formed with boss 72 of the spring housing 62 that supports the winding shaft 3. An attachment or a shaft may be equipped using the cavity 60 to enable the rotation to be transmitted directly from the winding shaft. Furthermore, a convex piece 73 can be formed at the edge of the cavity 60 in such a way that it projects from the upper surface of the case 8. The convex piece 73 can be utilized as a rotation stopper and a location determinant of a ground board or attachment. For example, the location is determined or the rotation is stopped in the following way:

(1) the ground board or attachment is machine screwed with either one of said four holes 79, 80, 81, 82;

(2) a hole 86 that fits over the convex piece 73 is formed in the ground or attachment; then (3) the hole 86 is fit over the convex piece 73.

By placing the drum 4 vertically on the frame 1, the first gear 12 can be lowered to the frame surface. Accordingly, if the music box is as tall as a conventional one, a space is created between the upper part of the spring and the case, by the discretionary height of the frame that was projected to level the bevel gear of a horizontally placed drum. Therefore, this invention utilizes the space; in the space, ribs 83 can be formed inside the housing 62, to reinforce the case 8, and at the same time, mounting holes 79, 80, 81 for the movable member (via the attachment or directly) also can be formed. In a conventional music box, for example, the winding shaft support was normally about 1.5 mm thick; however, in this invention, it is about 5 mm thick including ribs 83, and this music box performs as well or even better than the conventional music box of the same height. Also, the spring housing 61 of the case 8 has sufficient strength to resist axial impact.

In the neighboring area 43 of the drum 4, not being occupied by the case 8 covering the frame 1, a hole 45 is opened to retain a shaft (not illustrated) that transmits a rotation, rocking, or vertical movement of the movable member such as a doll or an ornament from the drum 4; the hole 45 also supports a gear 44 fixed on the shaft. Regarding the shaft, on which the gear 44 is installed, its upper end is rotatably supported by the attachment (not illustrated) fixed with one or more of the mounting holes 79, 80, 81, 82, 60 formed on the case 8 and at the same time, its lower end is held at the hole 45. In this way, the shaft is rotatably supported. The shaft with the gear 44 rotates faster than the drum 4. On the hole 45, the gear 44 or the attachment can be mounted or a shaft or pins can be fixed with machine screws or caulking so that the gear and the like rotate around the hole 45. Also, in the side space 46, 47 of the case 8, a gear 48 (phantom line) to transmit rotation may be formed by projecting the third worm 15 to the outside of the case. Or a bracket 49 (phantom line) may be formed to mount the attachment. For example, an arm 50 (phantom line) may be attached to the bracket 49 and be rockingly supported (FIG. 2) and a crank (not illustrated) may be mounted on the drum 4 side to rock the arm 50 by means of the crank rotation.

Accordingly, a music box constructed as above can be assembled in such a way that a support is constructed on the case 8 side and all the components such as gears and springs are dropped into the case 8 and then it is secured by covering with the frame 1. Accordingly, this music box is easy to assemble and is thin, light and economical. Since conventional music boxes have all the components such as gears and a drum on the frame 1, they require many projections on the frame 1 side to support the components. As a result, the music boxes are thick, heavy, and costly. This invention resolves this problem.

Due to the construction above, when the spring 2 is wound up by rotating the center winding shaft 3 and then, the stopper (not illustrated) is released from the brake member 7, the winding shaft 3 begins rotating in reaction to the release of the spring 2. The rotation of winding shaft 3 is transmitted to the first gear 12 via the ratchet 10 and the first gear rotates. The rotation of the first gear 12 is transmitted to the drum 4 via pinion and the drum 4 rotates. At this point, the rotation is transmitted to the accelerating gear row 6 that includes the second gear 13 meshing with the first gear 12; the rotation is acceleratedly transmitted in order of the second gear 13→the second worm wheel 14→the third worm 15→the third worm wheel 16→the fourth worm 17. Finally, the brake member 17 mounted to the fourth worm 17 is rotated at high speed. The brake member 7 prevents the first gear 12 from rotating at high speed because the rotors 55*c*, 55*c* rotate receiving air resistance, contact the wall surface of the fixed member 56 and brake the rotation. In this way, the drum 4 also rotates at a constant speed; therefore, the music box plays at a stable speed.

At this time, the rotation needed to drive the movable member is transmitted from the gear 44 in parallel with the gear 11 that is integrated with the drum 4. The rotation can be transmitted from the drum by press-fitting a shaft into the drum axis. In this way, the forces to move the movable member can be transmitted.

The second example of a music box of this invention is illustrated in FIG. 11 through FIG. 14. This example has a different structure from the one illustrated in FIG. 1 through FIG. 10 of the drum support structure, the comb stand, the caulking sections, the case shape, and a governor structure. For those elements having the same number in FIG. 1 through FIG. 10, no description is necessary since they represent the same structure.

Figure 12:
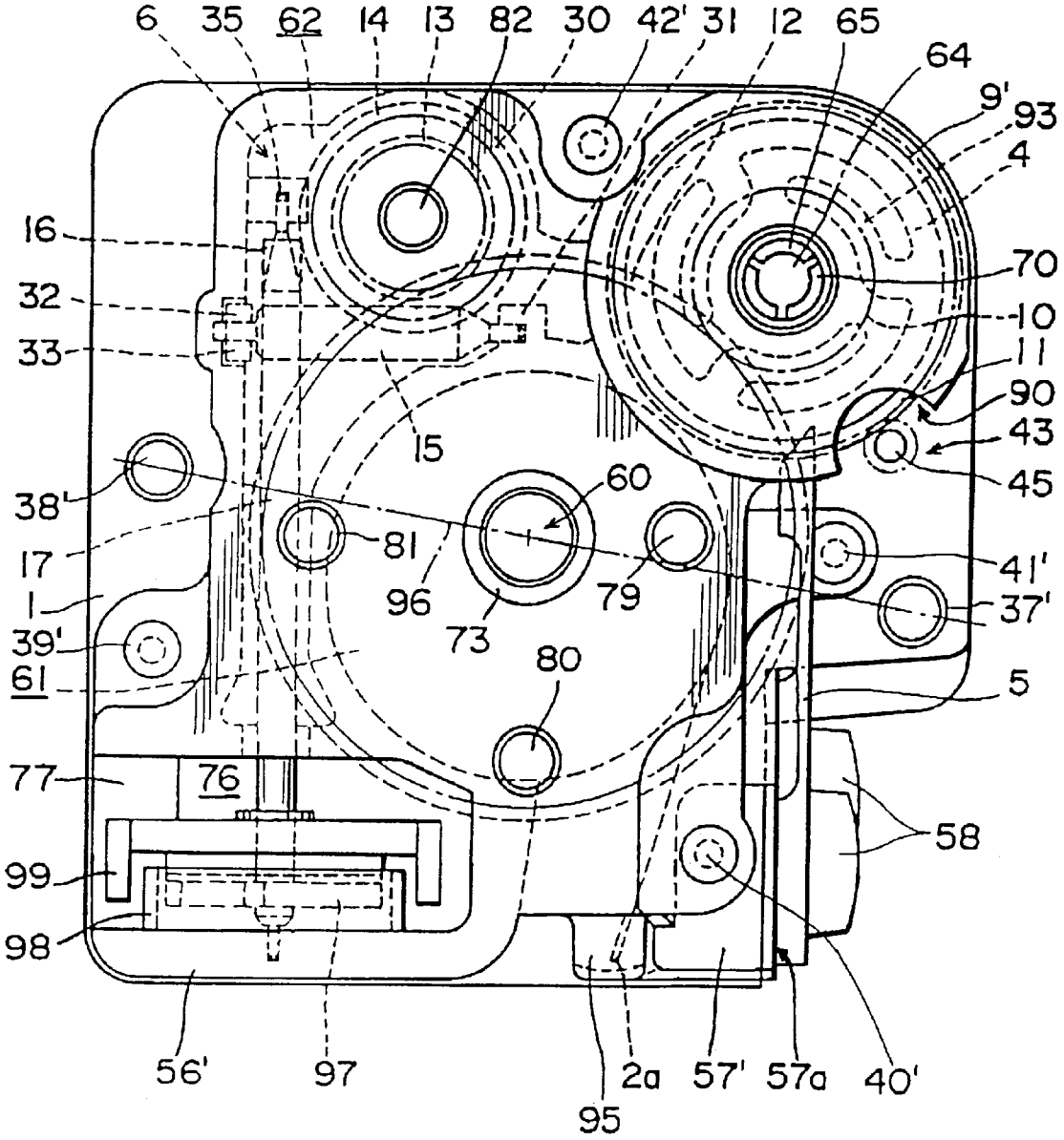
FIG. 12 illustrates a top view of the music box of FIG. 11.
Figure 13:
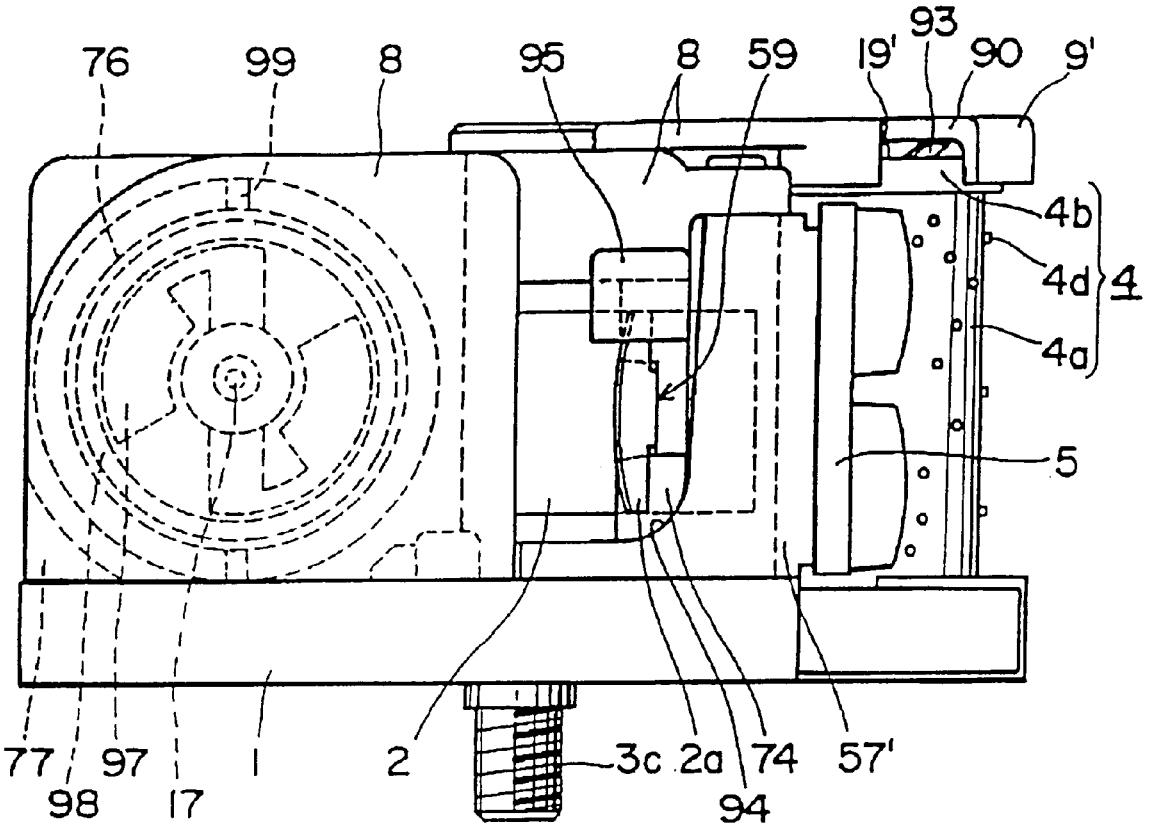
FIG. 13 illustrates a front view of the music box of FIG. 11.
Figure 14:
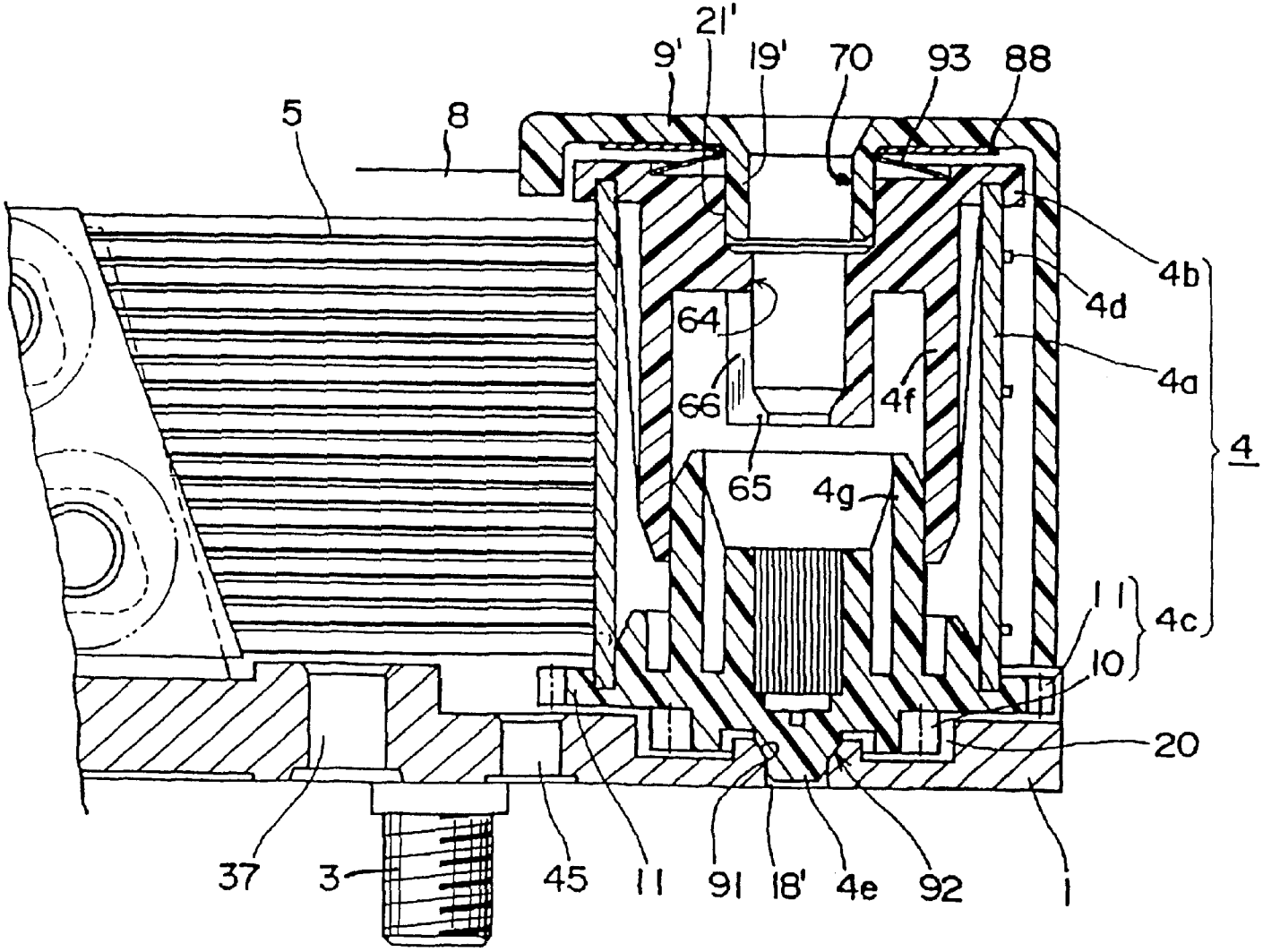
FIG. 14 illustrates a magnified cross section of the drum and its support structure of the music box of FIG. 11.

The drum 4 is arranged vertically against frame 1, at a corner of frame 1, and is rotatably supported by frame 1 and the drum support 9'. The drum support 9', which is projected from the case 8 in parallel with the frame 1, supports the drum in the vertical direction from the rotation center. The drum support is dish-shaped and big enough to cover the upper end board 4*b* of the drum. The drum 4 is rotatably supported as illustrated in FIG. 14 in the following way:

(1) the shaft part 4*e* integrated with the lower end board 4*c* is supported by the drum support hole 18' formed on the frame 1; and (2) the upper end board 4*b* is engaged with the shaft part 19' that is projected from the support member 9' integrated with the case. The drum support hole 18' is formed to support the tapered shoulder section 92 on the shaft part 4*e* of the end board 4*c*, when the opening at the lower end board 4*c* side of drum 4 is a tapered hole 91. On the other hand, the drum support 9' cannot take advantage of its elasticity due to the rigid design to cover the upper end board 4*b* of the drum 4 to protect it from drop impact. Then, by placing a spring 93 to drive the drum in the axial direction at a place between the drum support 9' and the upper end board 4*b*, the drum 4 is pressed to the taper hole 91 of the frame 1 and at the same time, a constant braking force is added to the drum 4. The cylinder-shape shaft part 19' formed inside the drum support 9' is inserted into the hole 21' on the upper end board 4*b* of the drum 4 to rotatably support the drum 4. A flat spring, for example, is used here for the spring 93. Pressed against the drum support via the washer 88, the flat spring 93 is mounted abrasably to the drum support 9'. The flat spring 93 contains three spiral legs extending to the axial direction as illustrated in FIG. 12 to minimize the spring constant and resolve the size variation of the parts, but this does not particularly limit the kinds which might be used. A notch 90 is formed in the area (the upper part of the hole 45) where a shaft (not illustrated) transmits rotation directly from the drum 4.

The upper end board 4*b* and the lower end board 4*c* are fit together by a direct press fitting to unite the entire drum. That is, with the inward projection of the integrated sleeves 4*f*, 4*g* from the upper end board 4*b* and the lower end board 4*c*, and press-fitting the sleeves 4*f*, 4*g* sandwiching the body 4*a* between both the end boards 4*b*, 4*c*, the three members—the both end boards 4*b*, 4*c* and the body 4*a*—are united. This structure can prevent the lower end board 4*c* from idling during a play, increase the rigidity of the drum 4, and improve the sound quality. Even with the form of this example, the gear 11, which transmits the force to the movable member such as an ornament formed on the drum end board 4*c*, needs to be protected from the impact caused by dropping. For this reason, the frame 1 is designed so big as to protrude slightly outside the gear 11 to keep the gear 11 inside the frame 1. Therefore, The edges of both drum end boards 4*b*, 4*c* are protected by the drum support 9' and frame 1, thus preventing being damaged by dropping.

A stand 57' of the comb 5 integrated with the frame 1 is manufactured in a trapezoidal shape. The comb is placed and fixed with screws so that the high frequency side is closer to the frame 1, that is, in the larger stand area, and the low frequency side is far from the frame 1, that is, in the smaller stand area. Corresponding to this, the drum 4 is arranged to position the high frequencies on the side closer to the frame 1 and position the low frequencies on the side closer to the supporting member 9'. Accordingly, the higher the frequency (the closer the drum is to the frame 1), the less the drum chatter is. In this way, when the comb is played, the drum axial movement is prevented and the music box produces clear sound.

The bottom of the stand 57' which crosses the frame 1 has a wavy surface 94 to change the vibration direction to orthogonal direction vertical to the frame 1. The surface transmits vibrations like a tuning fork. This structure increases the volume.

In the case 8, an eaves-shape projection 95, which covers the ear part 2*a* of the spring 2, is formed at the upper part of a spring engagement opening 59. The projection is there to have an ear part 2*a* at the end of the spring 2 hung above the spring engagement opening against the side wall surface of the case 8. This is where the spring engagement opening 59 is formed with the ribs 74 of the frame 1 and the wall at the case 8 side. In this case, because the upper ear part 2*a* of the spring 2 is fully covered with the projection 95 and there is the frame 1 underneath, the music box is easy to assemble, easy to be installed in ornaments, and easy to handle during shipping.

The way the frame 1 is installed in the mount of product is important in order to obtain excellent resonance. That is, if the part away from the comb 5 is fixed, the frame is insecure and cannot be pushed hard against the mount of product. If the frame 1 cannot be pushed evenly, distortion or unbalanced sound transmissions occur. In this example, then, two mounting holes 37', 38' are formed symmetrically to the center of the frame; that is, in the form of this example, at both ends of the winding shaft 3, that is at the center of the line 96 closest to the comb 5. In this way, the frame 1 is firmly fixed on a mount (not illustrated) such as an ornament with the least mounting places, thereby providing the best sound effects.

The case 8 is installed on the frame 1 with four caulkings, 49', 40', 41', 42'. It is preferable to form these four caulkings 49', 40', 41', 42', on each side of the almost square plane shape-like case 8; at least one caulking is positioned near the stand 57' of the comb 5, the most preferably on the stand 57'. In this case, the vibration of the comb 5 is effectively transmitted to the stand 57' and the case 8 functions as a resonator because it vibrates itself, resulting in possibly increasing the volume of the music box. For this reason, it is possible to lessen the effect of the volume deterioration with the minimized frame 1. The four caulkings are carried out by inserting the caulking pins projected from the frame 1 into the holes and crushing their heads. Case 8 may be fixed with machine screws or caulkings accordingly.

In the form of this example, the brake member comprises an almost S-shape brake board 97 deformable in the larger diameter direction receiving centrifugal force and a cup-type brake cup 98 positioned around the brake board 97. This prevents uneven braking force caused by errors in manufacturing and assembling. The brake member 7' has a large brake force: by fixing an almost S-shape rubber brake board 97 on the worm shaft 17 and by fixing the brake cup 98 surrounding the brake board 97 on the wall surface 56 of the case 8 so that when the brake member 7' receives centrifugal force in accordance with the rotating force of the worm shaft 17, it expands toward the brake cup on the outer side, and touches it, in this way, it provides friction brakes. Besides, the brake force can be obtained constantly regardless of the rotor position or the worm movement in the thrust direction. A fan 99, formed outside the brake cup 98, is fixed on the worm 17. The fan 99 rotating around the brake cup 98 maintains uniform rotation. A stopper (not illustrated) can be inserted into the fan member to stop the brake member.

It is apparent from the explanation above that the music box of this invention requires only a small area and eliminates the dead space for the holes under the drum or space under the vibrating teeth because the rotation axis of the drum is placed perpendicular to the frame surface and the comb is placed horizontally along the drum; as a result, it minimizes the frame size by aggregating the components. In this way, a compact and light-weight music box is obtained. Since the holes for the drum and the space beneath the vibrating teeth are dispensed with, a space for set screws can be created, thus useless space is eliminated to cause the placement of each of the constituent components to be more compact. Accordingly, a music box itself can be more compact. Further, since the frame size can be small, the weight also can be reduced greatly, for example, more or less 30% lighter, which also reduces the shipping cost. Since the winding shaft of the spring as well as the drum axis is perpendicular to the frame, the screw winding can be formed on the bottom surface side of the ornament. Also, the ornament can be rotated by utilizing the winding shaft.

While the foregoing description and drawings represent the preferred embodiments of the present invention, it will be obvious to those skilled in the art that various changes and modifications may be made therein without departing from the true spirit and scope of the present invention.

What is claimed is:

1. A compact music box comprising:

a comb having vibrating teeth;

a drum with a multiplexity of pins on an outer peripheral surface, said drum having a rotational axis;

a spring, having a winding shaft, which is a driving source of rotation for said drum;

an accelerating gear row for accelerating the rotation speed of the spring winding shaft upon release;

a brake member for engaging with said gear row and for braking upon the release;

a frame which transmits the vibration of said comb to a mounting member;

said spring being fixed on said frame so that the spring winding shaft is vertical to said frame;

a stand portion for mounting the bottom of said comb, said comb being fixed to said stand by at least one screw having a screw head which faces outward of said winding shaft to permit ready access to said screw heads;

the rotation axis of said drum and said comb being arranged vertically to said frame surface so that the vibrating teeth of said comb and the pins of said drum can be engaged with each other;

said comb, said drum, said accelerating gear row and said brake member being arranged about the shaft of said spring on said frame so as to provide a compact music box.

2. The music box according to claim 1, wherein said frame has a center and wherein the winding shaft of said spring is arranged about at the center of said frame.

3. The music box according to claim 1, wherein two steps of worm are used in said accelerating gear row.

4. The music box according to claim 2, wherein two mounting holes are arranged in said frame and located symmetrically about the frame center at a 180 degree angle, and one hole is located near said comb.

5. The music box according to claim 1, wherein said spring, said accelerating gear row, and said drum are covered with a case made of synthetic resin and are supported by said frame and said case.

6. The music box according to claim 5, wherein the music box is shaped with said frame and said case.

7. The music box according to claim 5, wherein an upper end of said drum is supported and covered by a part of said case, which diameter is larger than said end of said drum.

8. The music box according to claim 5, wherein a center of a lower end of the drum is supported at a tapered hole of the frame and a center of an upper end of the drum is supported by said case; the spring between said case and an end board for said drum pushes said drum against said frame.

9. The music box according to claim 5, wherein an outer side of the spring end sticking out of said case is covered by a projection of said case.

10. The music box according to claim 5, wherein said case is fixed to said frame with multiple spots, and one of said spots is arranged to be near a stand to fix the comb.

11. The music box according to claim 1, wherein the vibrating teeth on a high frequency side of said comb are arranged to be near to said frame and the comb is fixed to said frame.

12. The music box according to claim 1, wherein an engagement part of said spring is arranged at the bottom of a stand formed in said frame to fix said comb.

13. The music box according to claim 5, wherein a fixed wall formed near a stand to fix the comb and a gear housing part supporting the accelerating gear row are connected by a bridge.

14. The music box according to claim 1, wherein a drum surface of said drum is positioned between the winding shaft of said spring and the rotation axis of said drum.

15. A music box according to claim 1 further comprising a stand portion which is formed in said frame to mount the bottom of said comb, said comb being fixed to said stand by at least one screw having a screw head which faces outward of said spring winding shaft to permit ready access to said screw head.

16. A compact music box comprising:

a comb having vibrating teeth, said comb having a top and a bottom;

a drum with a multiplexity of pins on an outer peripheral surface, said drum having a rotational axis;

a spring which is the driving source of rotation of said drum, said spring having a winding shaft;

an accelerating gear row for accelerating the rotation speed of the spring winding shaft upon release;

a brake member for engaging with said gear row and for braking upon the release;

a frame which transmits the vibration of said comb to a mounting member;

a stand formed in said frame to mount the bottom of said comb;

wherein the rotational axis of said drum and the winding shaft of said spring are arranged vertically to said frame to provide compactness;

the top of said comb engages the pins of the drum; and said comb is fixed to said stand;

the plane of said comb is parallel to and positioned on a first side of a central plane through the center of the winding shaft; and the brake member is positioned on a second side of said central plane.

17. The music box according to claim 16, wherein said winding shaft is arranged on an inner side of said stand and said comb is fixed to an outer side of said stand.

18. The music box according to claim 16, wherein the winding shaft of said spring is arranged at about the center of said frame in the music box.

19. A music box according to claim 16, wherein a plane of said comb top is parallel to and positioned on a first side of a central plane through the center of the winding shaft, and the brake member is positioned on a second side of said central plane.

20. A music box comprising:

a comb having vibrating teeth;

a drum with a multiplexity of pins on an outer peripheral surface;

a spring, having a winding shaft, which is a driving source of rotation for said drum;

an accelerating gear row for accelerating the rotation speed of the spring winding shaft upon release;

a brake member for engaging with said gear row and for braking upon the release;

a frame which transmits the vibration of said comb to a mounting member;

a stand formed in said frame to mount said comb;

wherein the rotational axis of said drum and the winding shaft of said spring are arranged vertically to said frame to provide compactness; and said comb is fixed on an outer side of said stand, said spring winding shaft is arranged adjacent to an inner side of said stand with respect to the surface of said comb.

21. A music box according to claim 20, wherein said comb is fixed to said stand so that a rotational axis of said drum overlaps with the extended surface from a top of said comb.

22. The music box according to claim 20, wherein the winding shaft of said spring is arranged at about the center of said frame.

23. In a music box having a comb with a plurality of vibrating teeth, a drum having a rotational axis with a plurality of pins on an outer surface thereof for engaging ends of said teeth, a coil spring having a shaft for driving the drum and a base frame to which the comb, drum and coil spring are mounted, the improvement comprising an arrangement for making the music box more compact including:

the rotational axis of said drum and said shaft of said spring being disposed substantially parallel to each other and vertical to said base frame;

the shaft of the coil spring being substantially centered in the base frame;

the comb and drum being disposed on said base frame about said centered shaft of said coil spring; and a stand formed in said frame to mount a bottom of said comb, said comb being fixed to said stand by at least one screw having a screw head which faces outward of said spring winding shaft to permit ready access to said screw heads.

24. The music box of claim 23, wherein said coil shaft and said drum axis each extend from said base frame, the coil shaft extending a distance no greater than a distance that the rotational axis of the drum extends from the base frame.

25. The music box of claim 23, also including an accelerating gear row for accelerating the rotation speed of the spring and a brake member for engaging and for braking the gear row, said comb, said accelerating gear row and said brake member are disposed about said centered shaft of said coil spring.

* * * * *